US009136646B2

(12) United States Patent
Naito et al.

(10) Patent No.: US 9,136,646 B2
(45) Date of Patent: Sep. 15, 2015

(54) CONNECTOR SELECTABLY MATEABLE WITH A FIRST MATING CONNECTOR HAVING A FIRST INTERFACE AND A SECOND MATING CONNECTOR HAVING A SECOND INTERFACE

(71) Applicant: JAPAN AVIATION ELECTRONICS INDUSTRY, LIMITED, Shibuya-ku, Tokyo (JP)

(72) Inventors: Takeharu Naito, Tokyo (JP); Yoshifumi Kubota, Tokyo (JP); Toshio Masumoto, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 14/080,741

(22) Filed: Nov. 14, 2013

(65) Prior Publication Data

US 2014/0162484 A1 Jun. 12, 2014

(30) Foreign Application Priority Data

Dec. 6, 2012 (JP) ..... 2012-267025

(51) Int. Cl.
*H01R 13/627* (2006.01)
*H01R 27/00* (2006.01)
(Continued)

(52) U.S. Cl.
CPC ..... *H01R 13/6275* (2013.01); *H01R 27/00* (2013.01); *H01R 12/724* (2013.01); *H01R 24/62* (2013.01)

(58) Field of Classification Search
CPC .... H01R 13/64; H01R 13/641; H01R 13/648; H01R 13/6272; H01R 13/6275; H01R 13/639
USPC ..... 439/345, 353, 374, 350, 352, 357, 439/607.01, 607.04; 29/428, 874
See application file for complete search history.

(56) References Cited

U.S. PATENT DOCUMENTS 7,427,214 B2 * 9/2008 Liao et al. ..... 439/607.01
7,722,407 B2 * 5/2010 Momose ..... 439/638
(Continued)

FOREIGN PATENT DOCUMENTS

CN 200983449 Y 11/2007
CN 101527398 A 9/2009
(Continued)

OTHER PUBLICATIONS

Korean Office Action dated Feb. 17, 2015, issued in counterpart Korean Application No. 10-2013-0137407.
(Continued)

*Primary Examiner* — Amy Cohen Johnson
*Assistant Examiner* — Oscar C Jimenez
(74) *Attorney, Agent, or Firm* — Holtz, Holtz, Goodman & Chick PC

(57) ABSTRACT

A connector is selectably mateable with a first mating connector and a second mating connector. The first mating connector has a first interface and two lock portions. The second mating connector has a second interface. The connector comprises a shell. The shell has a standard portion, a modified portion and two coupling portions. The standard portion corresponds to both the first interface and the second interface. The modified portion and the coupling portions correspond not to the first interface but to the second interface. The modified portion is apart from the standard portion in an up-down direction. The coupling portion couples the standard portion and the modified portion. The shell is formed with two lock holes. The lock hole extends from the standard portion to the coupling portion. The lock holes receive the lock portions when the connector is mated with the first mating connector.

6 Claims, 9 Drawing Sheets

(51) Int. Cl.
*H01R 12/72* (2011.01)
*H01R 24/62* (2011.01)

(56) References Cited

U.S. PATENT DOCUMENTS

| | | | | |
|---|---|---|---|---|
| 7,967,641 | B2 | 6/2011 | Miyoshi | |
| 8,152,566 | B1 * | 4/2012 | Little et al. | 439/607.41 |
| 8,882,528 | B2 | 11/2014 | Sasho et al. | |
| 2008/0242149 | A1 | 10/2008 | Konno et al. | |
| 2011/0312200 | A1 * | 12/2011 | Wang et al. | 439/218 |
| 2011/0312223 | A1 | 12/2011 | Wang et al. | |

FOREIGN PATENT DOCUMENTS

| | | | |
|---|---|---|---|
| CN | 201741836 | U | 2/2011 |
| CN | 201741958 | U | 2/2011 |
| CN | 102290654 | A | 12/2011 |
| CN | 102290655 | A | 12/2011 |
| CN | 102570133 | A | 7/2012 |
| CN | 102646896 | A | 8/2012 |
| JP | 2002-315071 | A | 10/2002 |
| JP | 2008-010378 | A | 1/2008 |
| JP | 2008-251248 | A | 10/2008 |
| JP | 2010-027374 | A | 2/2010 |

OTHER PUBLICATIONS

Taiwanese Office Action dated May 22, 2015, issued in counterpart Taiwanese Application No. 102140981.

Chinese Office Action (and English translation thereof) dated Jul. 3, 2015, issued in counterpart Chinese Application No. 201310647829.6.

* cited by examiner

CONNECTOR SELECTABLY MATEABLE WITH A FIRST MATING CONNECTOR HAVING A FIRST INTERFACE AND A SECOND MATING CONNECTOR HAVING A SECOND INTERFACE

CROSS REFERENCE TO RELATED APPLICATIONS

An applicant claims priority under 35 U.S.C. §119 of Japanese Patent Application No. JP2012-267025 filed Dec. 6, 2012.

BACKGROUND OF THE INVENTION

This invention relates to a connector and, particularly, to a Universal Serial Bus (USB) connector.

For example, this type of connector is disclosed in JP-A 2008-251248 (Patent Document 1), content of which is incorporated herein by reference.

As shown in FIG. 18, the connector 900 of Patent Document 1 comprises a first contact 910 and a second contact 920 other than the first contact 910. The first contact corresponds to a standard contact of a standardized USB receptacle. The second contact 920 is an additional contact and is arranged at a position where a standardized USB plug is unreachable along a mating direction. Although the first contact 910 has a contact portion similar to the standard contact, the first contact 910 has a size larger than the standard contact in the mating direction because of the arrangement of the second contact 920. The first contact 910 and the second contact 920 are provided at different positions from each other in the mating direction.

The aforementioned connector 900 of Patent Document 1 has a problem that its size in the mating direction is large.

SUMMARY OF THE INVENTION

It is therefore an object of the present invention to provide a connector having a structure which can prevent the size of the connector from becoming larger in a mating direction.

In order to prevent the size of the connector from becoming larger in the mating direction while enabling a modification of the connector such as an addition of a contact, it is necessary to change an interface of the connector. In detail, the interface of the connector is required to be formed to correspond to both a standard interface of a mating connector and a special interface formed by modifying the standard interface.

The aforementioned interface of the connector is required to be compliant with a standard which defines a structure for maintaining a mated state of the connector with the mating connector. The aforementioned standard defines that, under the mated state, lock portions (lock protrusions) of the mating connector should be located within lock holes formed at a shell of the connector. This standard also defines a distance between the lock portions. Since the lock holes are required to receive the lock portions, an arrangement of the lock holes is also affected by this standard.

The interface of the connector is mainly formed by the shell. In general, the shell is formed by bending a metal plate. Accordingly, a modification of the interface is typically restricted by the position of the lock hole of the shell and a bending margin of the shell. For example, if the metal plate is bent in the vicinity of an edge of the lock hole, the shell might be deformed. Thus, it is generally difficult to largely modify the interface while the interface satisfies the aforementioned standard such as the positional condition of the lock hole.

According to the present invention, the position of the lock hole is not changed but the lock hole is enlarged to extend beyond the bending position of the shell. Accordingly, the metal plate can be bent without deformation of the shell. Moreover, the lock hole is able to receive the lock portion of the mating connector which is arranged in compliant with the standard. The present invention is made based on those studies.

One aspect (first aspect) of the present invention provides a first connector selectably mateable with a first mating connector and a second mating connector along a mating direction. The first mating connector has a first interface and two lock portions. The second mating connector has a second interface. The second interface has a shape partially different from the first interface in a plane perpendicular to the mating direction. The first connector comprises a contact, a holding member and a shell. The holding member holds the contact. The shell covers, at least in part, the holding member. The shell has a standard portion, a modified portion and two coupling portions. The standard portion corresponds to both the first interface and the second interface. The modified portion and the coupling portions correspond not to the first interface but to the second interface. The modified portion is apart from the standard portion in a predetermined direction perpendicular to the mating direction. Each of the coupling portions couples the standard portion and the modified portion. The shell is formed with two lock holes. The lock holes are formed to continuously extend from the standard portion to the coupling portions, respectively. The lock holes receive the lock portions under a mated state where the first connector is mated with the first mating connector. The lock holes which receive the lock portions maintain the mated state.

Another aspect (second aspect) of the present invention provides a second connector which is the first connector of the first aspect and further comprises features described below. The first mating connector comprises a plurality of first mating contacts. The second mating connector comprises a plurality of the first mating contacts, a plurality of second mating contacts and two lock portions. The second interface has an upper portion and a bulge. The bulge bulges from the upper portion in the predetermined direction. The bulge is located between the lock portions in a width direction perpendicular to both the mating direction and the predetermined direction. The shell is able to receive each of the first interface and the second interface. The coupling portions and the modified portion form a ditch. The ditch is recessed outward in the predetermined direction. The ditch receives the bulge when the second connector is mated with the second mating connector. The contacts include a plurality of first contacts and a plurality of second contacts. The first contacts are connectable to the first mating contacts, respectively. The second contacts are connectable to the second mating contacts, respectively. The holding member is provided with a plate-like portion. The plate-like portion has a first portion and a second portion located at a backside of the first portion. The second portion faces the ditch in the predetermined direction. The first contacts are located at the first portion. The second contacts are located at the second portion. When an end of the plate-like portion is seen along the mating direction, the second contacts are visible at the end of the plate-like portion.

Still another aspect (third aspect) of the present invention provides a second mating connector mateable with the second connector of the second aspect. The second mating connector comprises a mating end, a plurality of first mating contacts and a plurality of second mating contacts. The first mating contact has a first mating contact portion contactable with the first contact. The second mating contact has a second mating contact portion contactable with the second contact. A distance between the second mating contact portion and the mating end is larger than a distance between the first mating contact portion and the mating end.

An appreciation of the objectives of the present invention and a more complete understanding of its structure may be had by studying the following description of the preferred embodiment and by referring to the accompanying drawings.

Figure 1:
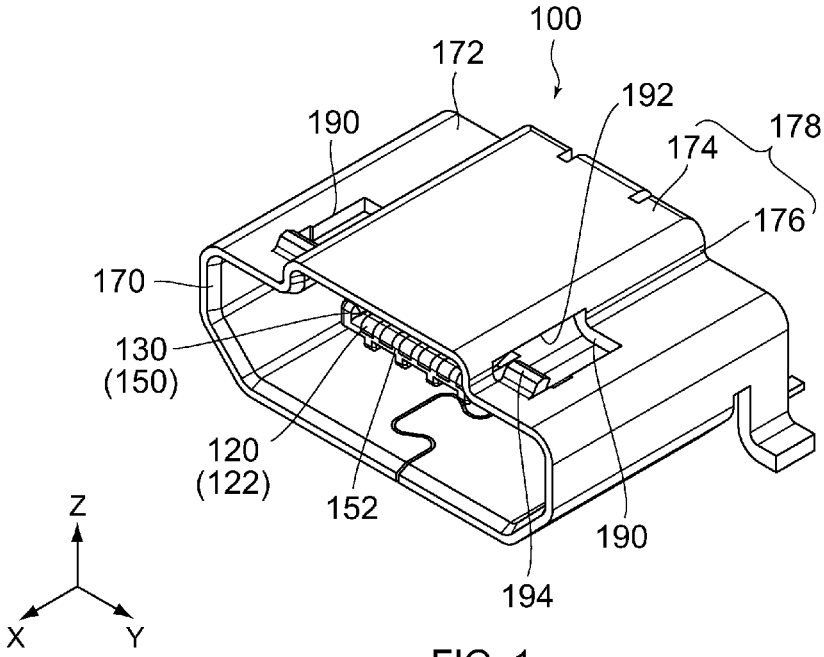
FIG. 1 is a top, perspective view showing a receptacle (connector) according to an embodiment of the present invention.
Figure 2:
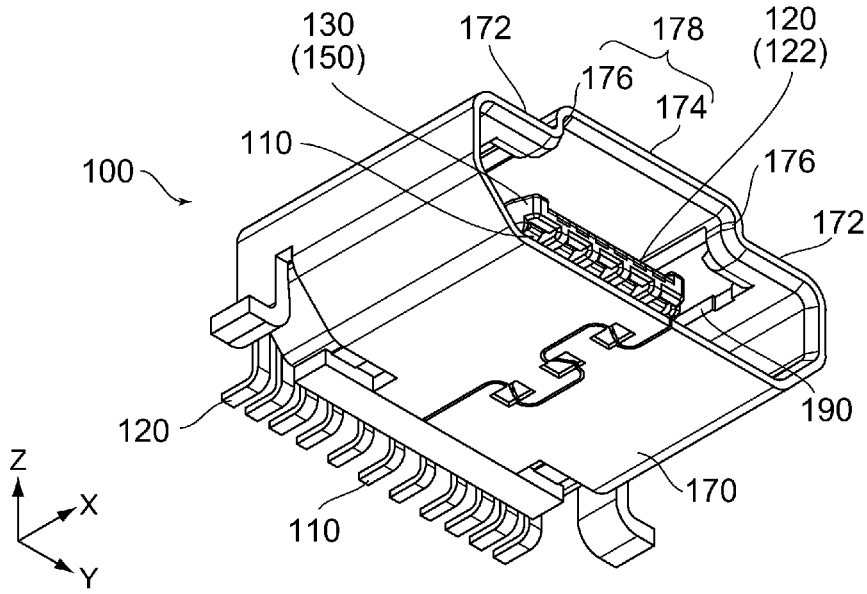
FIG. 2 is a bottom, perspective view showing the receptacle of FIG. 1.
Figure 3:
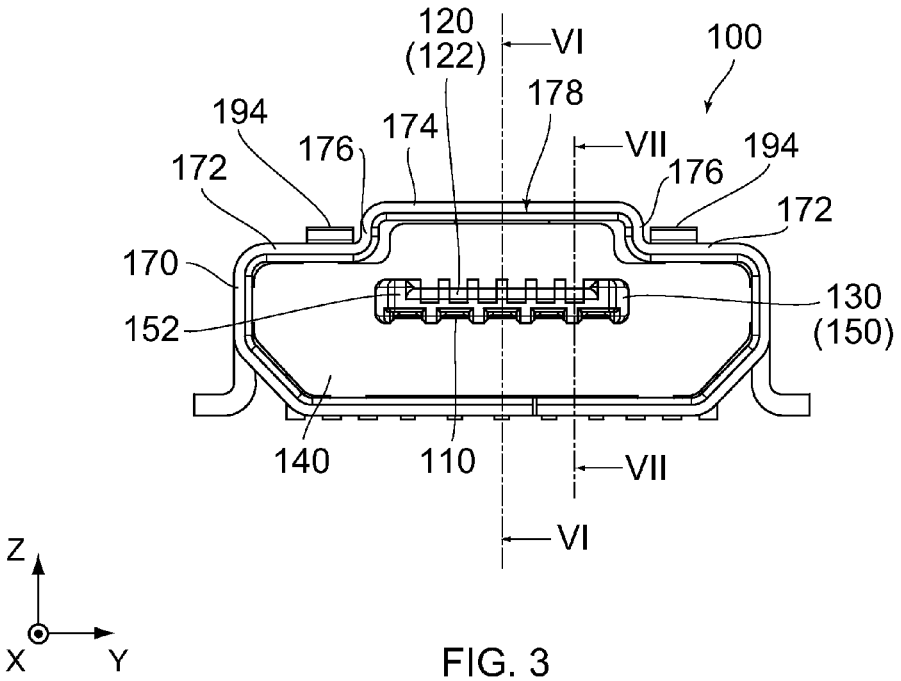
FIG. 3 is a front view showing the receptacle of FIG. 1.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIGS. 1 to 7, a connector 100 according to an embodiment of the present invention is a receptacle 100. The receptacle 100 is selectably mateable with a first plug (first mating connector) 200 shown in FIGS. 11 and 12 and a second plug (second mating connector) 300 shown in FIGS. 13 to 16 along a mating direction (X-direction). In detail, the receptacle 100 is configured similar to a Micro-B receptacle, which is compliant with a Universal Serial Bus (USB) 2.0 standard, except having additional terminals. The first plug 200 is a Micro-B plug which is compliant with the USB 2.0 standard. The first plug 200 is mateable not only with the receptacle 100 according to the present embodiment but also with the Micro-B receptacle which is compliant with the USB 2.0 standard. The second plug 300 is configured similar to the Micro-B plug except having additional terminals. The second plug 300 is not mateable with the Micro-B receptacle.

Figure 11:
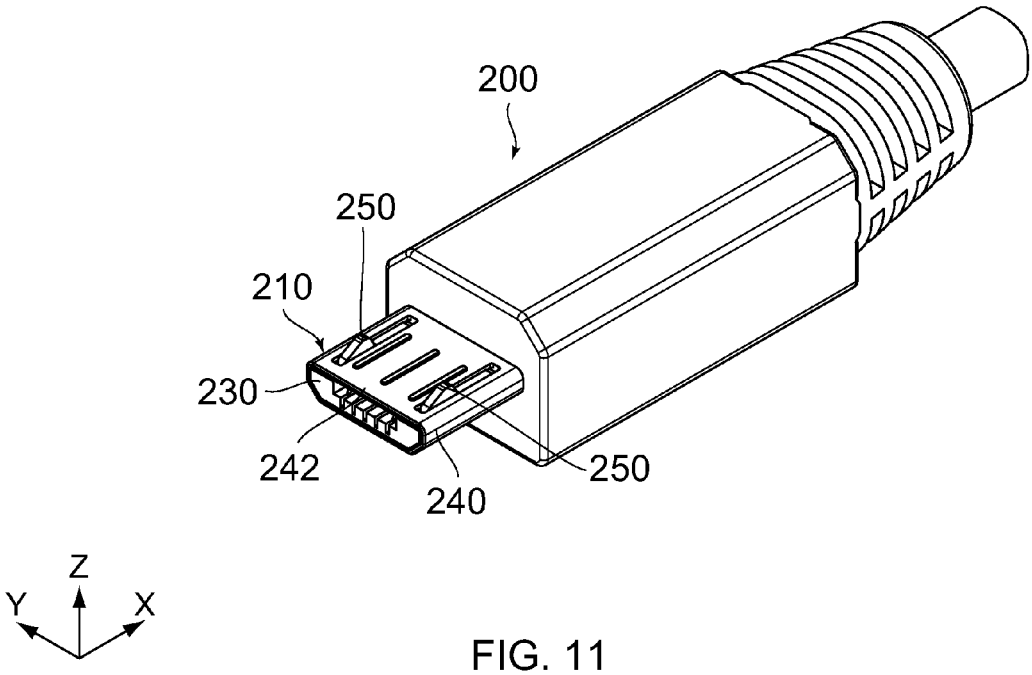
FIG. 11 is a perspective view showing a first plug (first mating connector) which is mateable with the receptacle of FIG. 1.
Figure 12:
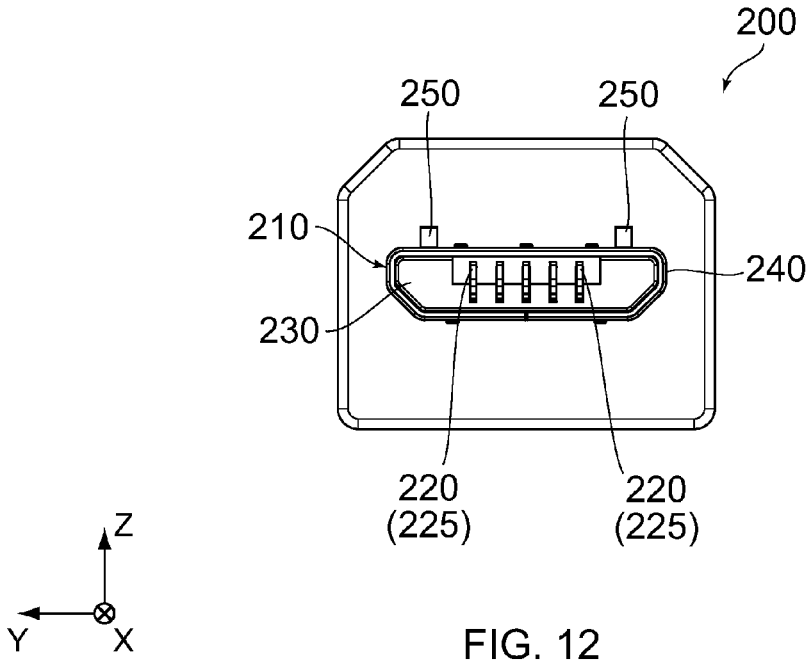
FIG. 12 is a front view showing the first plug of FIG. 11.
Figure 13:
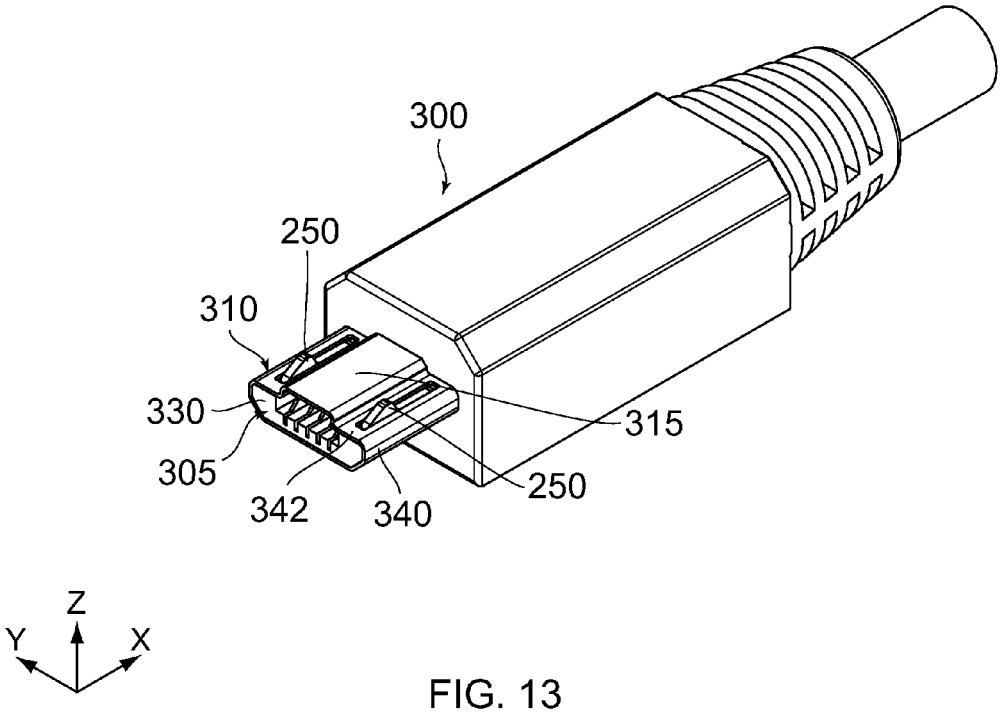
FIG. 13 is a perspective view showing a second plug (second mating connector) which is mateable with the receptacle of FIG. 1.

As shown in FIGS. 11 and 12, the first plug 200 has a first interface 210 compliant with the USB 2.0 standard. The first plug 200 has a plurality of first mating contacts 220 each made of a conductive material, a first mating holding member 230 made of an insulating material, a first mating shell 240 made of a metal and two lock portions (lock protrusions) 250 each made of a metal. The first mating holding member 230 holds the first mating contacts 220. The first plug 200 has the five first mating contacts 220 compliant with the USB 2.0 standard. The first mating contacts 220 are arranged in the Y-direction (width direction or pitch direction). The first mating shell 240 covers the first mating holding member 230. The first interface 210 is mainly formed of the first mating shell 240. When the lock portions 250 is applied with no load, the lock portions 250 protrude upward (in the positive Z-direction) from an upper portion 242 (positive Z-side part) of the first mating shell 240 in an up-down direction (Z-direction and predetermined direction). The lock portions 250 are movable in the Z-direction. The lock portions 250 are apart from each other in the Y-direction by a predetermined distance. The predetermined distance is defined in the USB standard.

Figure 14:
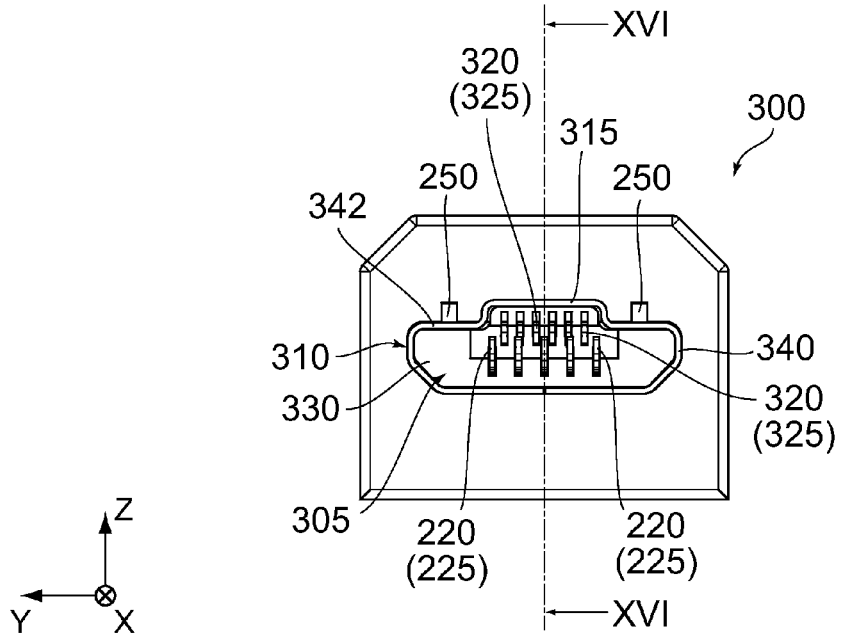
FIG. 14 is a front view showing the second plug of FIG. 13.

Comparing FIGS. 12 and 14 with each other, the second plug 300 has a second interface 310 which is different from the first interface 210 of the first plug 200. More specifically, the second interface 310 has a shape partially different from the first interface 210 in a plane (YZ-plane) perpendicular to the X-direction (mating direction). The second interface 310 has a main section and a bulge 315. The main section has the same shape as a part of the first interface 210. The bulge 315 is not included in the first interface 210. The bulge 315 bulges in the positive Z-direction (upward) from the main section. The second plug 300 has a plurality of second mating contacts 320 which are not provided in the first plug 200. The second mating contacts 320 are provided by modifying the first interface 210, particularly its outline.

Referring to FIGS. 13 to 16, the second plug 300 has a plurality of the first mating contacts 220 each made of a conductive material, a plurality of second mating contacts 320 each made of a conductive material, a second mating holding member 330 made of an insulating material, a second mating shell 340 made of a metal and the two lock portions 250. The second plug 300 has a mating end 305 which is an end thereof in the X-direction (mating direction).

Figure 16:
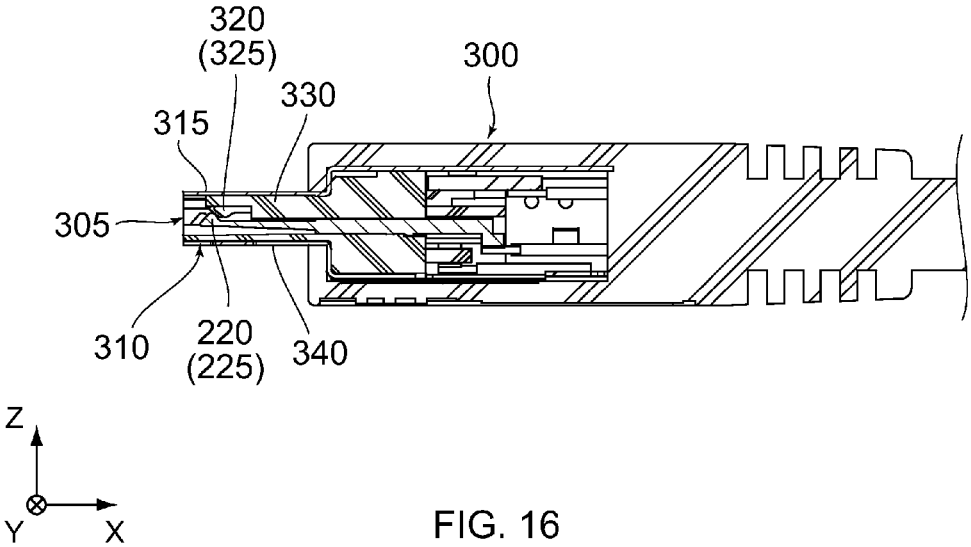
FIG. 16 is a cross-sectional view showing the second plug of FIG. 14, taken along line XVI-XVI.

The second mating holding member 330 holds the first mating contacts 220 and the second mating contacts 320. The first mating contacts 220 are arranged in the Y-direction. Similarly, the second mating contacts 320 are arranged in the Y-direction. In the present embodiment, the number of the second mating contacts 320 is six. Each of the first mating contacts 220 has a first mating contact portion 225 while each of the second mating contacts 320 has a second mating contact portion 325. The first mating contact portions 225 and the second mating contact portions 325 are contactable with respective contacts (described later) of the receptacle 100 and movable in the Z-direction. As best shown in FIG. 16, the second mating contact portion 325 is located toward the positive X-side (inner side) of the second plug 300 in the X-direction (mating direction) in comparison with the first mating contact portion 225. Thus, a distance between the second mating contact portion 325 and the mating end 305 is larger than a distance between the first mating contact portion 225 and the mating end 305.

Figure 15:
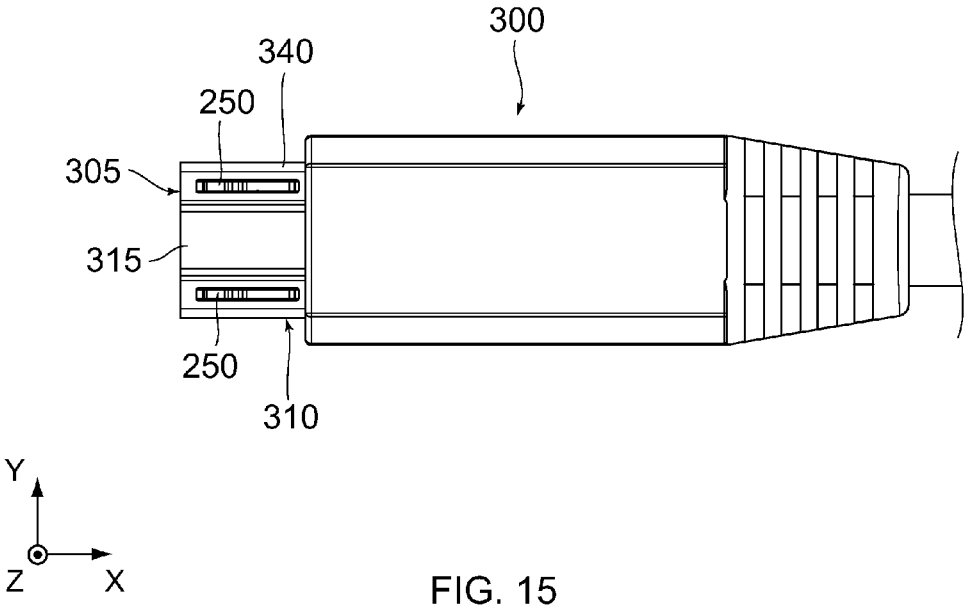
FIG. 15 is a plan view showing the second plug of FIG. 13.

The second mating shell 340 covers the second mating holding member 330. The second interface 310 is mainly formed of the second mating shell 340. The second mating shell 340 has an upper portion 342. The bulge 315 bulges upward (in the positive Z-direction) from the upper portion 342. Similar to the first plug 200, the lock portions 250 protrude upward (in the positive Z-direction) from the upper portion 342. As best shown in FIGS. 14 and 15, the bulge 315 is located between the lock portions 250 in the Y-direction (width direction).

As shown in FIGS. 1 to 7, the receptacle 100 comprises a plurality of first contacts (contacts) 110 each made of a conductive material, a plurality of second contacts (contacts) 120 each made of a conductive material, a holding member 130 made of an insulating material and a shell 170 made of a metal. Thus, the contacts 110 and 120 of the receptacle 100 include a plurality of the first contacts 110 and a plurality of the second contacts 120. In the present embodiment, the number of the first contacts 110 is five while the number of the second contacts 120 is six.

The first contacts 110 are connected to the first mating contacts 220, respectively, under a mated state where the receptacle 100 is mated with the first plug 200 or the second plug 300. In detail, the first contacts 110 are brought into contact with the first mating contact portions 225 under the mated state, respectively. According to the present embodiment, the first contacts 110 are compliant with the USB 2.0 standard. The second contacts 120 are additional contacts in the present embodiment. The second contacts 120 are connected to the second mating contacts 320, respectively, under the mated state where the receptacle 100 is mated with the second plug 300. In detail, the second contacts 120 are brought into contact with the second mating contact portions 325 under the mated state, respectively.

Figure 5:
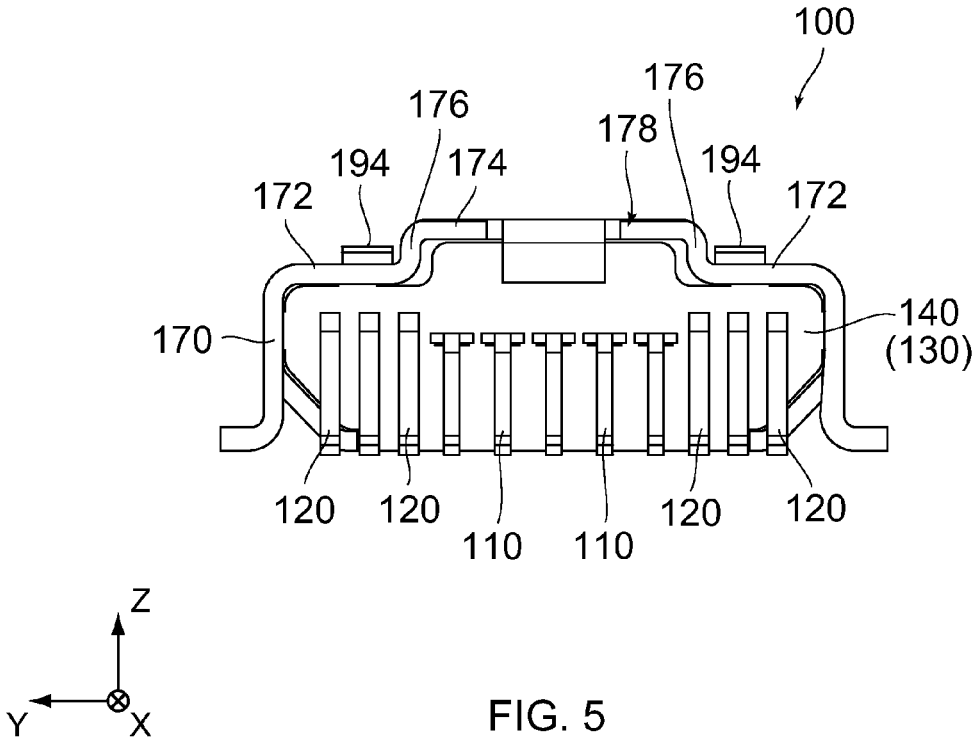
FIG. 5 is a rear view showing the receptacle of FIG. 1.
Figure 8:
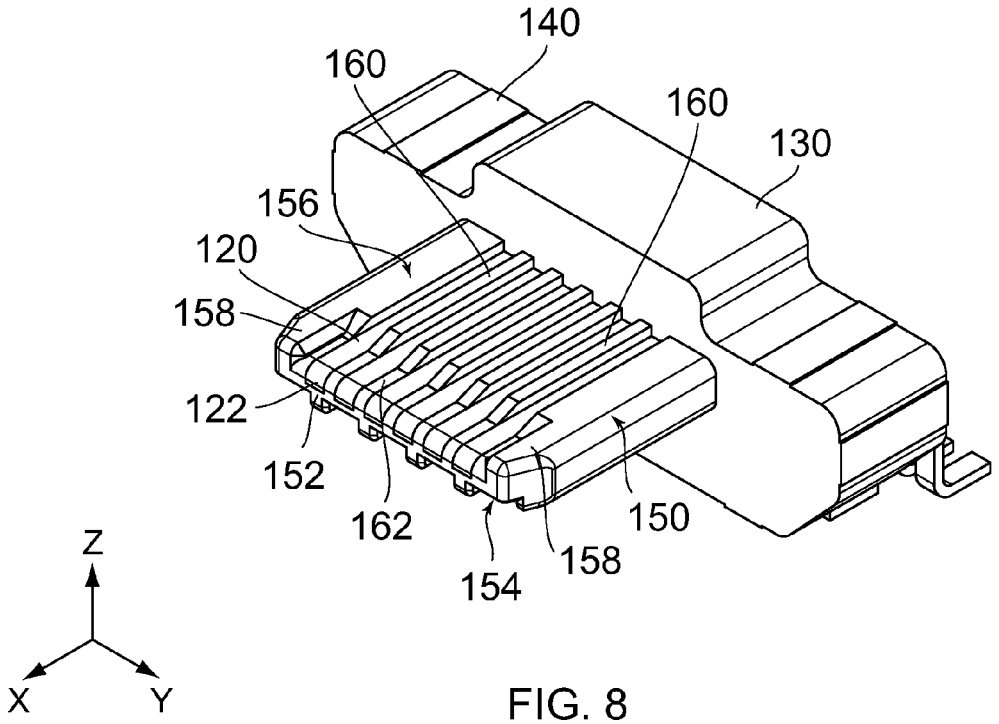
FIG. 8 is a top, perspective view showing contacts and a holding member included in the receptacle of FIG. 1.
Figure 9:
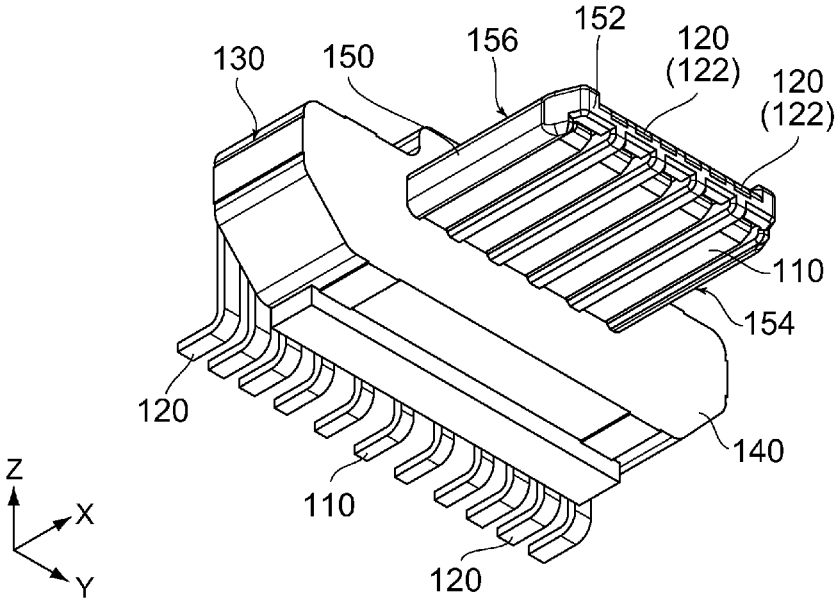
FIG. 9 is a bottom, perspective view showing the contacts and the holding member of FIG. 8.
Figure 10:
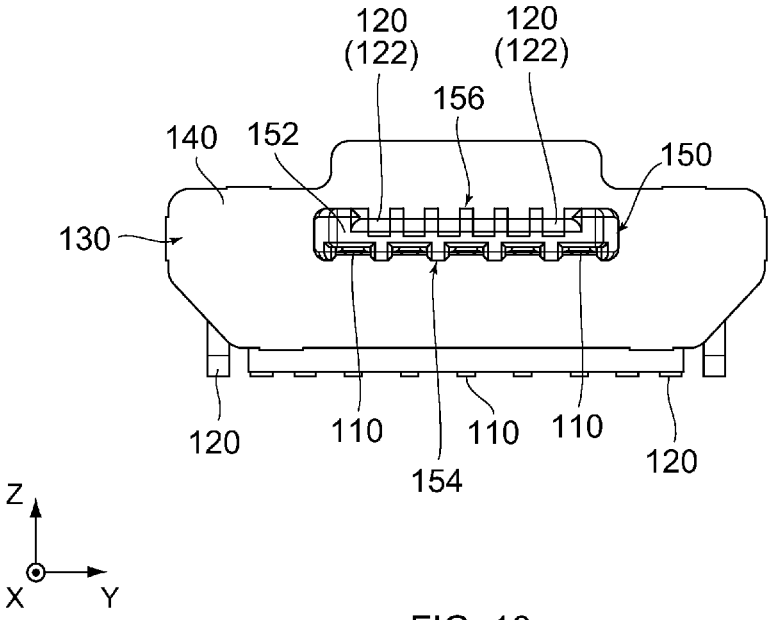
FIG. 10 is a front view showing the contacts and the holding member of FIG. 8.

As shown in FIGS. 8 to 10, the holding member 130 has a holding portion 140 and a plate-like portion 150. The holding portion 140 (holding member 130) holds the first contacts 110 and the second contacts 120. The first contacts 110 are press-fitted in the holding member 130 from a rear end (negative X-side end) thereof. The second contacts 120 are embedded in the holding member 130 via insert-molding. As shown in FIG. 5, when the holding member 130 is seen from the negative X-side (from behind), the second contacts 120 are arranged in two groups. The first contacts 110 are located between the two groups of the second contacts 120. However, the arrangement of the first contacts 110 and the second contacts 120 may be different from the aforementioned arrangement. Under the modified arrangement, the first contacts 110 may be embedded into the holding member 130 via insert-molding. Moreover, the second contacts 120 may be press-fitted into the holding member 130.

The plate-like portion 150 protrudes from the holding portion 140 along the X-direction. The plate-like portion 150 has a first portion 154 located at the negative Z-side (lower side) thereof and a second portion 156 located at the positive Z-side (upper side) thereof. Thus, the second portion 156 is located at a backside of the first portion 154. The first contacts 110 are located at the first portion 154 while the second contacts 120 are located at the second portion 156.

As shown in FIGS. 8 and 9, the second contacts 120 extend to an end 152 of the plate-like portion 150. Each of the second contacts 120 has an end portion 122. Each of the end portions 122 is exposed on the end 152. When the end 152 of the plate-like portion 150 is seen along the negative X-direction, the end portions 122 of the second contacts 120 are visible at the end 152 (see FIG. 10).

As previously described, the second mating contact portion 325 of the second mating contact 320 is further apart from the mating end 305 in the X-direction than the first mating contact portion 225 of the first mating contact 220 (see FIG. 16). Accordingly, if the second contact 120 has the same shape as the first contact 110, a contact effective length of the second contact 120 becomes shorter than another contact effective length of the first contact 110. According to the present embodiment, the second contact 120 extends so as to be exposed on the end 152 of the plate-like portion 150. Accordingly, the second contact 120 is able to have a sufficient contact effective length.

As shown in FIG. 8, the second portion 156 is formed with two side portions 158 and a plurality of partition walls 160. The side portions 158 are located at opposite sides of the second portion 156 in the Y-direction, respectively. Each of the partition walls 160 is located between two of the second contacts 120 in the Y-direction. The partition walls 160 are apart from the end 152 of the plate-like portion 150. In other words, the partition walls 160 are not located in the vicinity of the end 152 of the plate-like portion 150. The second portion 156 is further formed with a plurality of predetermined portions 162. Each of the predetermined portions 162 is located between two of the second contacts 120 and located in the vicinity of the end 152 of the plate-like portion 150. The predetermined portions 162 do not protrude beyond the second contacts 120 in the Z-direction. As described above, the partition walls 160 are not formed in the vicinity of the end 152 of the plate-like portion 150. Especially, according to the present embodiment, surfaces of the predetermined portions 162 form a plane practically common to surfaces of the second contacts 120. According to the present embodiment, the partition walls 160 are not formed in the vicinity of the end 152 of the plate-like portion 150 so that it is possible to prevent the vicinity of the end 152 of the plate-like portion 150 from being brought into abutment with the second mating contact 320 to be damaged during the mating process.

As can be seen from FIGS. 2, 3, 9 and 10, the shell 170 according to the present embodiment partially covers the holding portion 140 (i.e. the holding member 130). Moreover, the shell 170 surrounds the plate-like portion 150 in the YZ-plane (a plane perpendicular to the X-direction).

As shown in FIGS. 1 to 7, the shell 170 has a standard portion 172, a modified portion 174 and two coupling portions 176. The shell 170 according to the present embodiment is able to receive each of the first interface 210 of the first plug 200 and the second interface 310 of the second plug 300.

Figure 17:
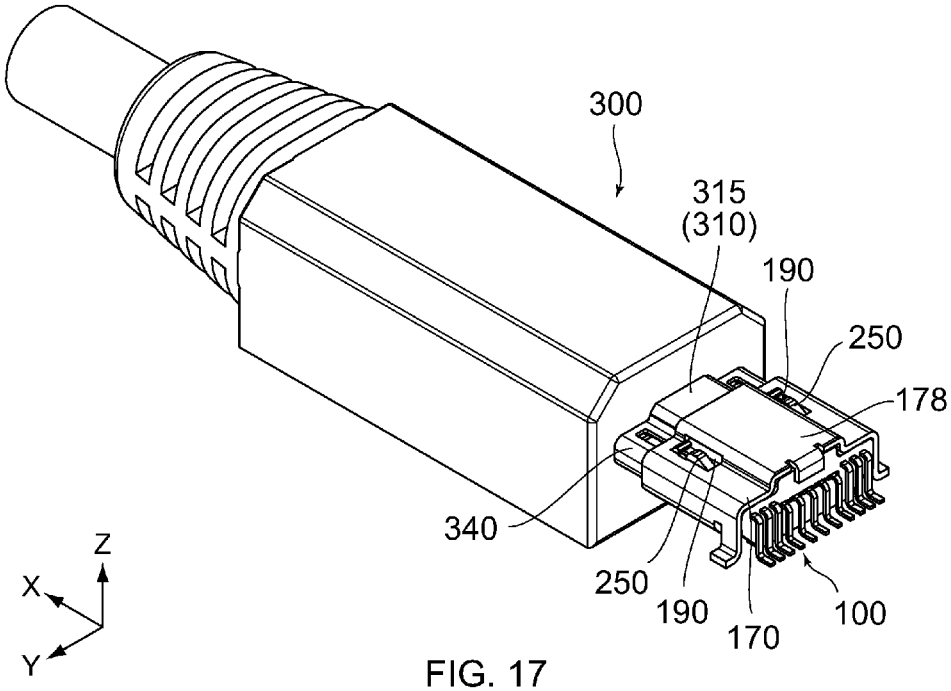
FIG. 17 is a perspective view showing the receptacle of FIG. 1 and the second plug of FIG. 13 under a mated state where the receptacle and the second plug are mated with each other.
Figure 18:
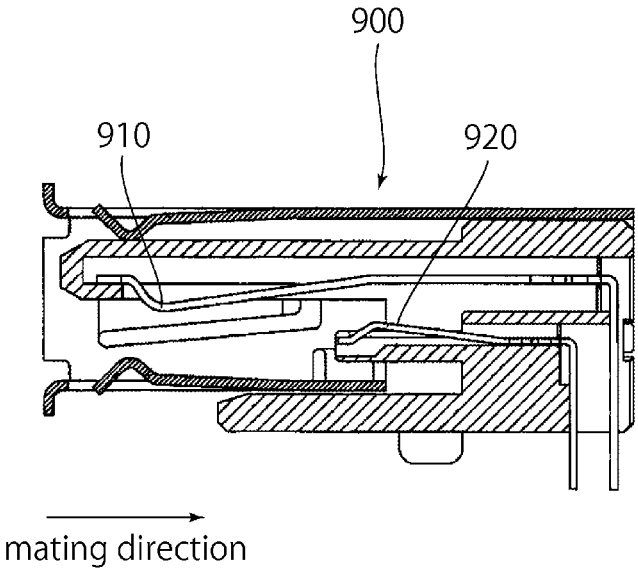
FIG. 18 PRIOR ART
FIG. 18 is cross-sectional view showing the connector of Patent Document 1.

The standard portion 172 corresponds to both the first interface 210 and the second interface 310. More specifically, the standard portion 172 has a shape which corresponds to both the first interface 210 and the second interface 310. The standard portion 172 according to the present embodiment is able to receive the first interface 210. Moreover, the standard portion 172 is able to receive the second interface 310 except the bulge 315. The modified portion 174 has a plate-like shape as a whole. The modified portion 174 is apart from the standard portion 172 in the Z-direction. Each of the coupling portions 176 couples the standard portion 172 and the modified portion 174. The modified portion 174 and the coupling portions 176 are thus coupled to each other to form a ditch 178. The ditch 178 is recessed outward (according to the present embodiment, recessed upward) in the Z-direction. The ditch 178 has a wide and reversed U-like shape when the receptacle 100 is seen along the mating direction. The ditch 178 is located above the plate-like portion 150. In other words, the second portion 156 of the plate-like portion 150 faces the ditch 178 in the Z-direction. As shown in FIG. 17, the ditch 178 receives the bulge 315 of the second interface 310 when the receptacle 100 is mated with the second plug 300. Thus, the modified portion 174 and the coupling portions 176 correspond not to the first interface 210 but to the second interface 310. More specifically, the ditch 178, which is formed of the modified portion 174 and the coupling portions 176, has a shape which corresponds only to the second interface 310.

Figure 4:
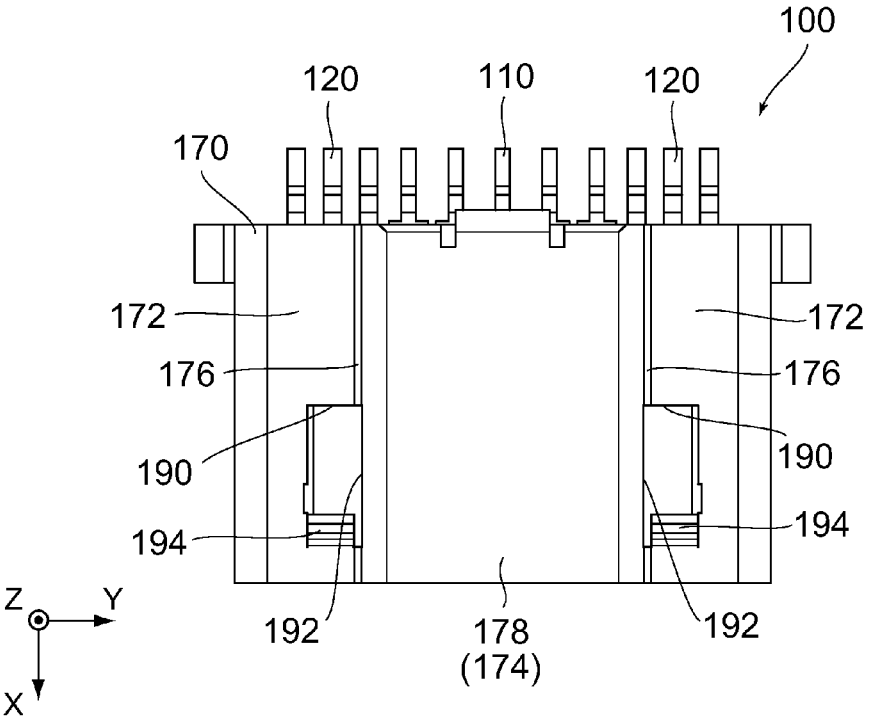
FIG. 4 is a plan view showing the receptacle of FIG. 1.

As shown in FIGS. 1, 4 and 17, the shell 170 is formed with two lock holes 190. The lock holes 190 and the lock portions 250 maintain the mated state when the first plug 200 or the second plug 300 is mated with the receptacle 100. According to the present embodiment, under the mated state of the receptacle 100 with the first plug 200 or the second plug 300, the lock holes 190 receive the lock portions 250, respectively. The lock holes 190 which receive the lock portions 250 maintain the mated state.

The size of the ditch 178 affects the arrangement and the number of the second contacts 120. The size of the ditch 178 is preferred to be large for arranging the second contacts 120 as many as possible with as long intervals as possible. However, since the lock holes 190 are configured to receive the lock portions 250 which are apart from each other by the predetermined distance according to the standard, the positions of the lock holes 190 are also restricted by the standard. Moreover, the shell 170 is obtained by bending an intermediate metal plate after the intermediate metal plate is punched out from a single metal plate. If the intermediate metal plate is bent in the vicinity of an innermost edge 192 of the lock hole 190, the shell 170 might be deformed. Accordingly, it is not preferred to bend the intermediate metal plate at a part which includes the innermost edge 192 of the lock hole 190. As shown in FIGS. 1 to 4, the lock holes 190 according to the present embodiment extend to the ditch 178. The innermost edges 192 of the lock holes 190 are located within the coupling portions 176, respectively. More specifically, each of the lock holes 190 is formed to extend continuously from the standard portion 172 to the coupling portion 176. Thus, each of the lock holes 190 has two side edges extending from the standard portion 172 to the coupling portion 176. The two side edges of the lock hole 190 are bent at the middle thereof. The bent part of each of the side edges is located at a boundary portion between the standard portion 172 and the coupling portion 176. In other words, the lock hole 190 is formed to continuously extend across the boundary portion between the standard portion 172 and the coupling portion 176. When the lock holes 190 are thus configured, it is possible to enlarge the size of the ditch 178 without undesirably deforming the shell 170. Moreover, it is possible to enlarge the size of the bulge 315 corresponding to the ditch 178. Accordingly, it is possible to improve a degree of freedom in number and arrangement of the second contacts 120 and the second mating contacts 320.

Figure 6:
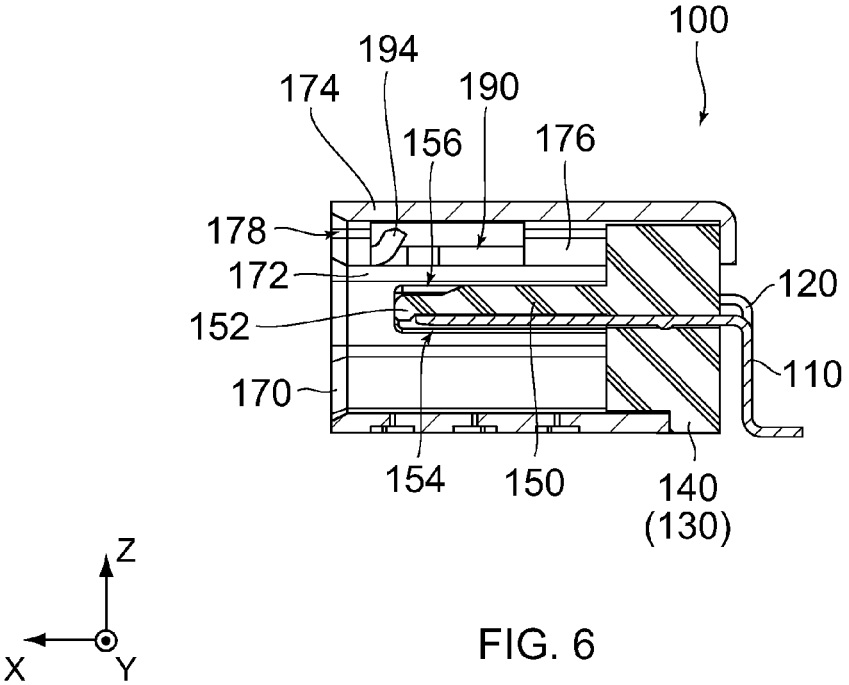
FIG. 6 is a cross-sectional view showing the receptacle of FIG. 3, taken along line VI-VI.
Figure 7:
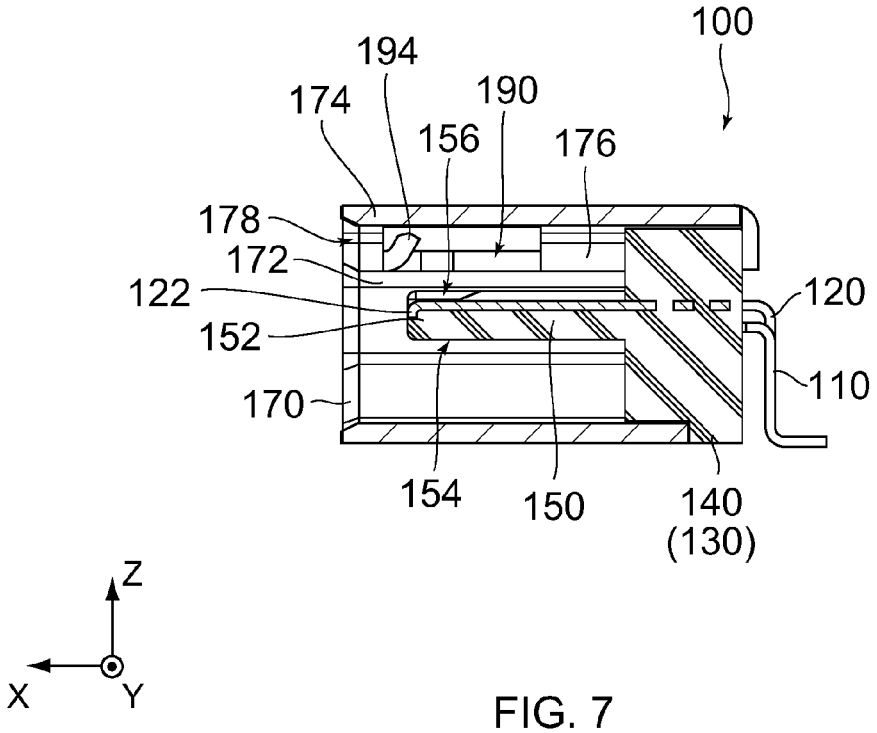
FIG. 7 is a cross-sectional view showing the receptacle of FIG. 3, taken along line VII-VII.

As shown in FIGS. 1 and 6, each of the lock holes 190 has a front end (positive X-side end) which is located toward the mating side of the receptacle 100. The front end of each of the lock holes 190 is formed with a locked portion 194. The locked portion 194 extends in the lock hole 190 from the front end of the lock hole 190 while curving. The locked portion 194 is located toward the mating side of the receptacle 100. The locked portion 194, which is thus configured, enables the lock hole 190 and the lock portion (lock protrusion) 250 to have a large engagement amount. Moreover, as shown in FIG. 6, the locked portion 194 has roundness. Accordingly, the protrusion of the lock portion (lock protrusion) 250 is hardly to be shaved during the mating process with the receptacle 100 and the removing process from the receptacle 100.

As shown in FIGS. 1 and 4, although the innermost edge 192 of the lock hole 190 according to the present embodiment is located in the coupling portion 176, the present invention is not limited to this configuration. For example, the size of the lock hole 190 may be further enlarged so that the innermost edge 192 of the lock hole 190 may be located at the modified portion 174. However, considering the electromagnetic shielding effect of the shell 170, the innermost edge 192 of the lock hole 190 is preferred to be located at the coupling portion 176 similar to the present embodiment.

As described above, the receptacle 100 according to the present invention has an improved degree of freedom in modification of its interface. Accordingly, for example, it is possible to add nonstandard special contacts to the receptacle 100 by modifying the interface. According to the present invention, it is possible to avoid the size of the receptacle 100 in the mating direction becoming large when the receptacle 100 is provided with the special contacts.

The receptacle (connector) 100, the first plug (first mating connector) 200 and the second plug (second mating connector) 300 are not limited to the embodiment and the modifications which are already described. As described below, the present invention is able to be variously modified.

For example, according to the embodiment described above, the connector is a receptacle while the first and second mating connectors are plugs. However, the connector may be a plug while the first and second mating connectors may be receptacles. In this case, the receptacle, which is the first or second mating connector, is provided with lock portions while the connector, which is the plug, is formed with lock holes. Moreover, the lock holes are formed to continuously extend from a standard portion, which corresponds to both a first interface and a second interface, to respective coupling portions which correspond only to the second interface. Accordingly, it is possible to enlarge a size of a part which is formed of a modified portion and coupling portions.

In the embodiment described above, the first plug 200 comprises a structure compliant with the USB standard while the receptacle 100 and the second plug 300 are modifications of connectors compliant with the USB standard. However, the present invention is applicable to various connectors different from those connectors. For example, the present invention is applicable to a connector compliant with a standard other than the USB standard. Moreover, the present invention is applicable to a connector which is not compliant with any standard.

The present invention is applicable to a connector having a shell formed with two lock holes. The thus-configure connector may not be a USB connector. Especially, the present invention is effective when the special contacts are added to the connector having the standard contacts.

The present application is based on a Japanese patent application of JP2012-267025 filed before the Japan Patent Office on Dec. 6, 2012, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector selectably mateable with a first mating connector and a second mating connector along a mating direction, the first mating connector having a first interface and two lock portions, the second mating connector having a second interface, the second interface having a shape different from the first interface in a plane perpendicular to the mating direction, and the connector comprising:

a contact;

a holding member holding the contact; and a shell covering, at least in part, the holding member, the shell having a standard portion, a modified portion and two coupling portions, the standard portion corresponding to both the first interface and the second interface, the modified portion and the coupling portions corresponding not to the first interface but to the second interface, the modified portion being apart from the standard portion in a predetermined direction perpendicular to the mating direction, each of the coupling portions coupling the standard portion and the modified portion, the shell being formed with two lock holes, the lock holes being formed to continuously extend from the standard portion to the coupling portions, respectively, such that each of the lock holes has a part which is located at a respective one of the coupling portions, the lock holes receiving the lock portions under a mated state in which the connector is mated with the first mating connector, and the lock holes which receive the lock portions maintaining the mated state.

2. The connector as recited in claim 1, wherein:

the second mating connector has two lock portions;

the second interface has an upper portion and a bulge, the bulge bulging from the upper portion in the predetermined direction;

the bulge is located between the lock portions in a width direction perpendicular to both the mating direction and the predetermined direction;

each of the first interface and the second interface is receivable in the shell;

the coupling portions and the modified portion form a ditch, the ditch being recessed in the predetermined direction; and the ditch receives the bulge when the connector is mated with the second mating connector.

3. The connector as recited in claim 2, wherein:

the first mating connector comprises a plurality of first mating contacts;

the second mating connector comprises a plurality of the first mating contacts and a plurality of second mating contacts;

the connector comprises a plurality of the contacts;

the contacts include a plurality of first contacts and a plurality of second contacts, the first contacts being connectable to the first mating contacts, respectively, and the second contacts being connectable to the second mating contacts, respectively;

the holding member is provided with a plate-like portion, the plate-like portion having a first portion and a second portion located at a backside of the first portion;

the second portion faces the ditch in the predetermined direction;

the first contacts are located at the first portion; and the second contacts are located at the second portion.

4. The connector as recited in claim 3, wherein the second portion is formed with a part which is located between two of the second contacts and located in a vicinity of an end of the plate-like portion, the part not protruding beyond the second contacts in the predetermined direction.

5. The connector as recited in claim 3, wherein the second contacts are visible at an end of the plate-like portion when the end of the plate-like portion is viewed along the mating direction.

6. The connector as recited in claim 5, wherein the second mating connector comprises a mating end;

wherein each of the first mating contacts of the second mating connector has a first mating contact portion contactable with the plurality of first contacts, respectively; and wherein each of the second mating contacts of the second mating connector has a second mating contact portion contactable with the plurality of second contacts; and wherein a distance between each second mating contact portion and the mating end is larger than a distance between each first mating contact portion and the mating end.

* * * * *